US006214164B1

(12) United States Patent
Rantala

(10) Patent No.: US 6,214,164 B1
(45) Date of Patent: Apr. 10, 2001

(54) PROCESS FOR PRETREATING WOOD CHIPS FOR PULPING

(75) Inventor: Pekka Rantala, Kauniainen (FI)

(73) Assignee: Sunds Defibrator Woodhandling Oy, Pori (FI)

( * ) Notice: Subject to any disclaimer, the term of this patent is extended or adjusted under 35 U.S.C. 154(b) by 0 days.

(21) Appl. No.: 09/117,162

(22) PCT Filed: Jan. 31, 1997

(86) PCT No.: PCT/FI97/00054

§ 371 Date: Aug. 7, 1998

§ 102(e) Date: Aug. 7, 1998

(87) PCT Pub. No.: WO97/28305

PCT Pub. Date: Aug. 7, 1997

(30) Foreign Application Priority Data

Jan. 31, 1996 (FI) ..... 960456

(51) Int. Cl.[7] ..... D21B 1/16

(52) U.S. Cl. ..... 162/25; 162/26; 162/27

(58) Field of Search ..... 162/25, 26, 27, 162/37, 60; 241/159, 224, 225, 235, 236, 293

(56) References Cited

U.S. PATENT DOCUMENTS 3,227,606 * 1/1966 Bidwell ..... 162/191

4,953,795 * 9/1990 Bielagus ..... 241/159

4,968,385 * 11/1990 Amador et al. ..... 162/18

* cited by examiner

*Primary Examiner*—Dean T. Nguyen

(74) *Attorney, Agent, or Firm*—Kubovcik & Kubovcik

(57) ABSTRACT

The invention relates to a process and apparatus for pretreating pulp raw material, to be subsequently prepared in a chemical pulping process, and for preparing cellulose pulp from a fibrous starting material. According to the process the starting material is delignified to yield a chemical cellulose pulp, and the obtained pulp is bleached when desirable. According to the invention the starting material is crushed in cooking liquor prior to delignification in order to open its fiber structure. The apparatus of the invention comprises a frame (21), to which to adjacent first rolls (12; 22, 23) have been fitted, which form a first pair of rolls with the rolls arranged to distance from each other in such a manner that a gap clearance is formed between their outer mantles. The rolls are caused to rotate by a means of power transmission, which causes the raw material to be crushed inside the gap between the rolls where a liquid pocket is formed, from which liquid is absorbed into the fiber material being treated. The invention provides even cooking of the raw material under mild conditions.

15 Claims, 2 Drawing Sheets

PROCESS FOR PRETREATING WOOD CHIPS FOR PULPING

BACKGROUND OF THE INVENTION

The present invention concerns a process for preparing cellulose pulp. According to such a process a fiber-based-starting material is delignified in cooking liquor containing cooking chemicals to yield pulp, and the obtained pulp is bleached if desired.

This invention also relates to an apparatus for the pretreatment of raw material for pulping processes to enhance delignifiability.

Recent development in the pulp industry has resulted in ever greater and more expensive investments. The most modem pulp mills already produce over 2000 metric tons of pulp per day. The cost of such mills is about FIM 4–5 billion, and there are not many customers in the world who can take such an enormous technological and economic risk. In the future, the ever increasing environmental pressures will introduce new risk factors as well. Logistics, the transportation of raw materials and products worldwide, constitutes both a cost factor and an environmental risk. One of the disadvantages of the big mills is that they require quite homogeneous raw material. Raw material with varying fibre properties cannot be fed into the cooking process without adverse effects on the pulp properties.

There are thousands of environmentally less friendly small pulp mills in the world, especially in Asia. The general development in the industry has not reached these areas, because it has not been regarded as profitable to develop environmentally friendly small-scale mills by the major suppliers of technology. However, in the recent years, the interest in these small mills facing closing down has increased. As regards the raw material base, they are more flexible than larger mills. Thus, almost 15% of all pulp is made from annual plants, non-wood fiber material, in such small scale pulp mills.

Annual plants have the advantage as raw material that they are easy to cook in a homogeneous manner. Contrary to this, it is typical of pulping processes based on the use of wood chips that the surface and the inner parts of the chips become treated differently. The surface zone is "overcooked" and the inside remains "raw". A similar phenomenon occurs if the starting material for pulping processes comprises a combination of annual and perennial plants, the annual ones being cooked with considerable ease in comparison to the perennial ones. The average quality achieved during grinding (refining) is a combination of fibers with different degrees of ripeness. In mechanical pulping processes, in which the raw material is subjected to mechanical impacts, the pulping effect achieved is more even than in the case of chemical pulping. For example, the grinding effect of a grinding stone on the surface layer of wood is equal to that imposed on the fibres of the inner layer during the preparation of ground wood pulp.

In order to cause the lignin glueing together the fibers in the wood chips to dissolve throughout during chemical pulping, it is necessary to cook the chips at an elevated temperature and pressure. Thus, the cooking installation with a pressure cooking vessel will be quite expensive, wherefore only the above-cited large mills (>400 000 tons of pulp/year) are economically profitable using known techniques.

It would be ideal to arranger such conditions for chemical pulp production that each fiber in the wood material receives identical treatment. This is well known, but no suitable method in which the fiber structure is not broken down too extensively has been discovered.

The object of this invention is thus to provide an entirely novel approach to the preparation of pulp by a chemical pulping process. More specifically, it is the object of this invention to provide a method which causes the pulping process to become homogeneous in such a way that the strength properties of the fibers are retained. This being the case, so called wood material of lesser value (such as alder, aspen and mixed tropical hardwood) can be used for the preparation of usable pulp.

This invention is based on the principle that wood chips or similar lignocellulosic raw material is precrushed to cause its structure to become open. The precrushing according to this invention is performed in a pulsating manner, with the aid of pressure shocks in the cooking liquour, which causes the fiber structure of the raw material to become efficiently impregnated with the cooking liquour due to the alternation of elevated and reduced pressure action during the crushing stage. The fibers start becoming cooked already in connection with the pretreatment, and the invention provides a three-stage cooking process, in which the raw material separates into fibers during all the three stages, presoaking, crushing and cooking. By using the same liquor (possibly diluted with water during the pretreatment stage) it is also possible to facilitate the handling and regeneration of liquids in the process.

Some techniques for precrushing wood chips are previously known in the art. These have been described in the following patent specifications: FR 2 276 420, FI 70937, FI 77699, FI 94968 and SE 461 796. In prior art apparatuses, the chips are usually pressed between two rolls in order to cause the chips to become crushed or to facilitate impregnation by liquids. An apparatus consisting of two pairs of rolls positioned on top of each other is described in Fl Patent Specification No. 94968, in which apparatus an "agressive" profile is formed on the surface of the rolls. This kind of serrated profile causes sharp, cutting surfaces that cut fibers and weaken the strength properties of the raw material to be treated.

SUMMARY OF THE INVENTION

In the present invention the inventors have sought to avoid the cutting mechanical action associated with the techniques known in the art, and to cause the breaking action to be in the direction of the length of the fibers. Therefore, the rolls for the crushing treatment of raw material in the apparatus according to the invention have toothed grooves which wind in a spiral manner on the surface of their outer mantles and consist of grooves and ridges. The walls of the grooves are continuous. By varying the efficiency of the crushing treatment, this invention can be applied both in the case of perennial fibers (wood chips) and in the case of material from annual plants. With the aid of this invention wood fibers can be caused to be after heavy treatment in a similar state as fibers from annual plants after mild treatment, in which case they can be cooked together or by using the same processing apparatus without danger of overcooking the latter fibers.

The invention has several advantages. Thus, conventional cooking methods for pulping can be considerably simplified and made less extensive. The capital expenditure can also be considerably reduced, which renders small pulp mills (less than 150 000 tons per annum) profitable. Raw material of lesser quality can be used to prepare pulp of better quality than is possible by the known methods. An essential aspect of the invention relates to its application to previously known pulping processes to provide the advantages described herein above.

In order to achieve a good cooking result, it is sufficient to use essentially milder cooking conditions (pressure and temperature) than in conventional pulping of wood chips. Therefore, temperatures in the range of 90–110° C., depending on the cooking chemicals even 70–100° C., and normal atmospheric pressure or possibly a slightly elevated pressure are sufficient. The excess pressure is typically about 1.001–2, preferably about 1.01–1.5, and most preferably about 1.05–1.25 bar (absolute pressure). Removal of air from the pulp can be made more efficient and the effect of temperature on the cooking process can be enhanced, for example, in the screw cooker described below, by cooking under reduced pressure. Expressed as an absolute pressure, the pressure is less than 1 bar, most suitably greater than about 0.5 bar and preferably about 0.7–0.9 bar.

Consequently, compared to the conditions in sulphate pulping of wood chips (160–170° C., 4–8 bar) the entire process apparatus can be renovated. Correspondingly, in so called normal pulping, the pretreatment of the invention obtains stronger pulp.

In this invention the problems with respect to homogeneity in chemical pulping have been solved by treating the fibers of the raw material of pulp mechanically, which has a homogenising effect that renders the fiber material more easily accessible to the cooking chemicals. Due to the homogeneity and milder than normal cooking conditions of the pulping process the cellulose fibers are not cleaved, and thus, they do not lose a significant part of their specific strength as is the case in normal pulping processes.

It is well known that the degree of bleaching is determined by the fibers in which the lignin (mucilage) content is high. The pulp provided by the present invention is bleached more readily and in an environmentally friendlier manner, due to its homogeneity, than conventional pulps.

The process described herein can be performed in a separate installation, but it is also excellently suitable for integration into an existing sulphate pulp mill. The pretreatment of material into wood mass provides possibilities to perform mild pulping in a very gentle manner and by retaining properties of the individual fibers of the wood material. The method provides considerable economic profits and advantages for environmental protection, for example, by making it possible to use wood of lesser value/quality in a useful manner.

An interesting embodiment of the invention provides for the cooking of waste from saw mills and plywood/chipboard production plants operating in tropical areas and leavings and chippings after timber cutting according to the technique made possible by this invention, whereby the cooking is carried out in small pulp mills (50 000–100 000 tons/year) to yield pulp which is further integrated into paper/board manufacturing.

BRIEF DESCRIPTION OF THE DRAWINGS

The invention is described in detail in the following and with reference to the enclosed figures.

Figure 1:
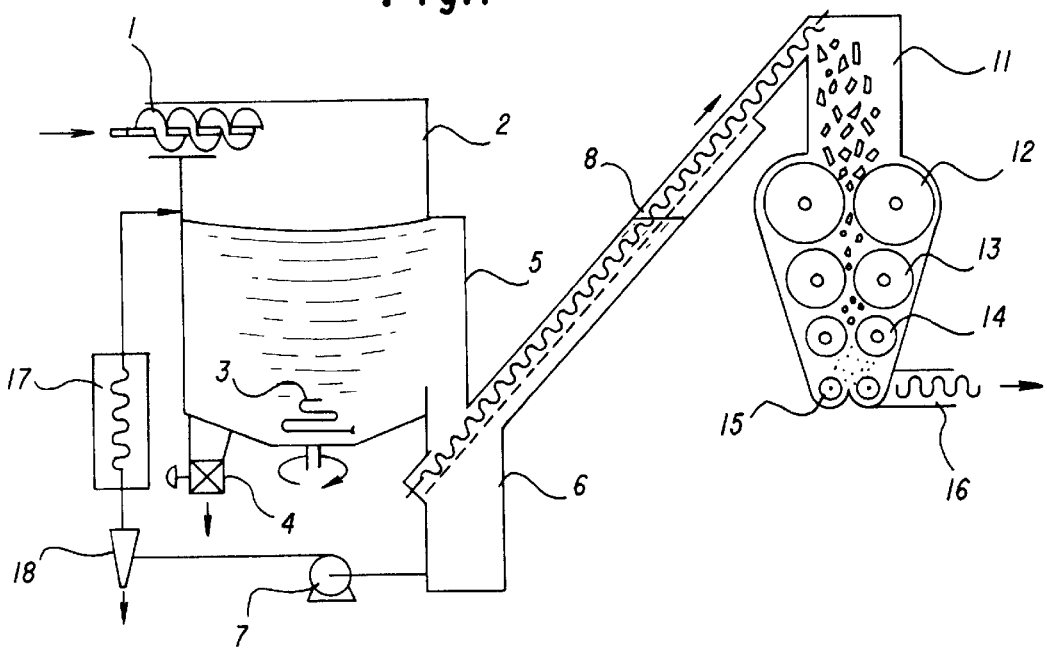
FIG. 1 shows a schematic drawing of the operating principle of the apparatus of the invention.

As described herein above, the invention comprises a two-fold object:

1) the structure of wood material is opened up in such a manner that all fibers receive similar treatment during pulping; annual plants and bamboo are treated according to the same method, but under milder conditions; and 2) the fiber mass is subjected to pulping under mild conditions by applying existing technology,
   with, for example, lye, formic acid (as in the MILOX process) or alcohol (ethanol) as the effective chemical, and
   whereafter the pulp can be bleached (with oxygen/peroxide) or used as such for manufacturing packing board, for example.

DESCRIPTION OF THE PREFERRED EMBODIMENTS

According to a preferred embodiment of the invention, cellulose pulp is prepared from conventional wood chips. The chip size is typically such that each chip is about 5–50 mm long (for example 10–30 mm) and 2–20 mm in thickness (for example, 5–15 mm). The chip can be sorted or unsorted, and the raw material used according to the invention can also be shavings, splinters and similar waste from mechanical forestry/wood industry. The wood material can be from domestic species, such as pine, spruce, birch, alder and aspen, but the chips can also be produced from other kinds of wood, including such as eucalyptus, maple and mixed tropical hardwood. The invention can also be applied to annual plants, such as straws from grain crops, reed canary-grass, reeds and bagasse.

When using wood, it is cut to chips in a manner that as such is known in the art, whereafter the chips, with a relative humidity of 30–50%, are subjected to a pretreatment according to the invention, in which they are washed at a temperature of 30–95° C., preferably in the range of about 40–80° C., with cooking liquor to remove sand and the like, typically silicate based impurities. During the washing stage the wood chips begin to become impregnated with liquid. The cooking liquor used consists of the same liquid as is used in the actual pulping stage. When alcohol is used as the cooking liquid the maximum temperature is most suitably about 60° C. The cooking liquor can be used as such or it can be diluted with water in ratio (cooking liquor/water) 10:1–1:1000, preferably 1:1–1:10, most preferably 1:2–1:5, before treatment. When the cooking liquor is used as such or slightly diluted, delignification can be caused to begin already during the washing step.

The cooking liquor used for washing is recycled via a purification step. During purification solid impurities, extracted wood constituents and the like impurities are removed from the liquor, whereafter it can be used again for washing.

The chips that have been pretreated with cooking liquor are subjected to mechanical crushing, in which the chips are subjected to repeated, most suitably pulsating, mechanical concussions, which effect a pressure that shapes the fiber structure of the wood material. The pressure causes the structure of the wood to open. Opening of the fiber structure is enhanced by removal of water from the fibers as a result of the pressure shocks directed to the material. Due to the fact that the crushing treatment is performed in liquid, the fibers are impregnated with liquid immediately after the pressure is reduced, that is, in between the strikes of the crusher. The treatment according to the invention is effective in causing the fibers to become evenly impregnated with liquid and the wood structure to become efficiently opened. Also the inner layers of the wood material are impregnated with liquid. In the ideal case, all or almost all the individual fibers receive a similar treatment during pulping, and thus, come into contact with the cooking liquor. The pulsating alternation of excess and reduced pressure states, together with the effect of mechanical crushing, effects the desired opening of the fibrous raw material in such a way that the pulping process can be carried out in a homogeneous manner. The technique used for crushing must not cut the fibers; instead, disintegration takes place in the direction of the length of the fibers.

After the treatment described herein above, the fibrous raw material is in the form of homogeneous wood mass, typically as a suspension of water/cooking liquor containing splinter-like raw material ("sludge"). The liquid content of the fiber material (amount of liquid of the dry weight of the fiber) is about 20–80%, in particular about 40–60%, typically about 50%.

The treatment of the invention can, most suitably in a slightly milder form, be performed with annual plants.

Any suitable apparatus can be used for the crushing treatment, provided it can subject the fibers to a sufficiently strong pressure effect without cutting the fibers. An apparatus that is especially well suitable for the treatment has been shown in FIGS. 1–4.

The apparatus according to the invention comprises a wash and mixing tank 2 intended for washing the chips, a feed conveyor 8 for the chips, and a crusher 10 for the chips. The chips are fed to the tank 2 with the aid of, for example, a spiral conveyor 1. A mixer 3 (rotor) is situated on the bottom of the tank to keep the liquid in continuous motion, to ensure that air bubbles are removed from the chips and that the chips are well impregnated. It is advantageous to form a vortex of liquid inside the tank, which facilitates separation of the chips from solid impurities (as described herein below). Pulpers developed for treatment of recycled paper are an example of mixing tank models that are especially suitable for use according to the invention.

Pebbles and other solid impurities are collected from the bottom of the tank 2 into an emptying funnel 4, from which they can be removed. Washed, wet wood chips are removed via a side exit line 5 and moved to a feed conveyor 8, 10. The side exit line extends almost from the bottom of the tank (typically it starts 20–30 cm above the bottom) most suitably to the surface of the liquid.

The feed conveyor 8, 10 comprises, for example, a spiral screw conveyor 8 fitted inside a tube 10, under which spiral screw a perforated partitioning plate is positioned in order to separate liquid from the chips. The said perforated plate can be changed. Excess wash liquid is drained through the perforated plate and is run off to a recycling tank 6, from which it is recycled to mixing tank 2 through a pump 7. Because the tank 2 and the line 10 are in liquid connection with each other, the line is partly filled with liquid. This causes the chips transported with the aid of the spiral conveyor into the crusher to contain as much liquid as possible.

A heat exchanger is positioned between the pump and the mixing tank for controlling the temperature of the washing liquor. The cooking liquor separated from the chips after the crushing treatment (as described herein below) is most suitably combined with the recycled wash liquor before the heat exchanger, because it has had time to cool during crushing treatment and purification.

A separator 18 can be placed in the pipe line for the separation of sand and the like impurities from the recycled liquor. It is preferable to use a high-consistency separator, which operates in a centrifugal manner.

Figure 2:
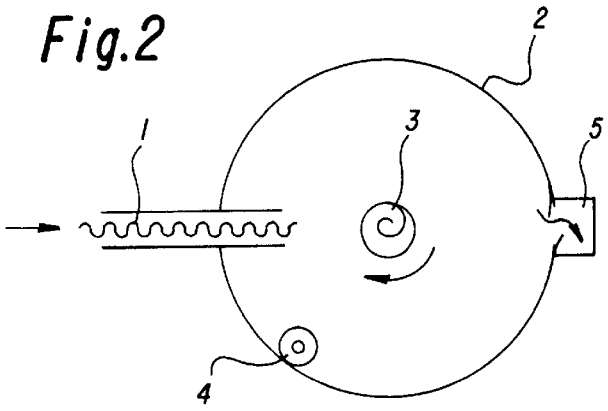
FIG. 2 shows a transverse section of the wash tank viewed from above.
Figure 4:
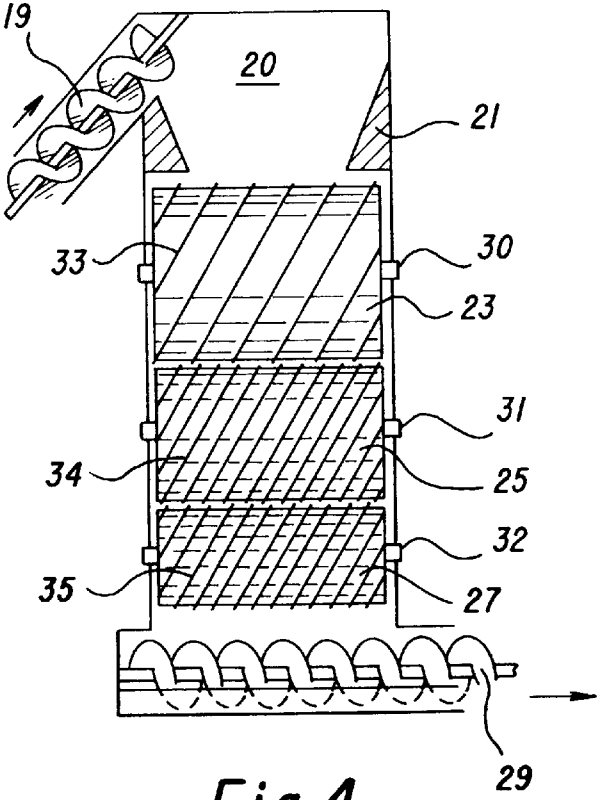
FIG. 4 shows a transverse section III—III of the crusher.
Figure 3:
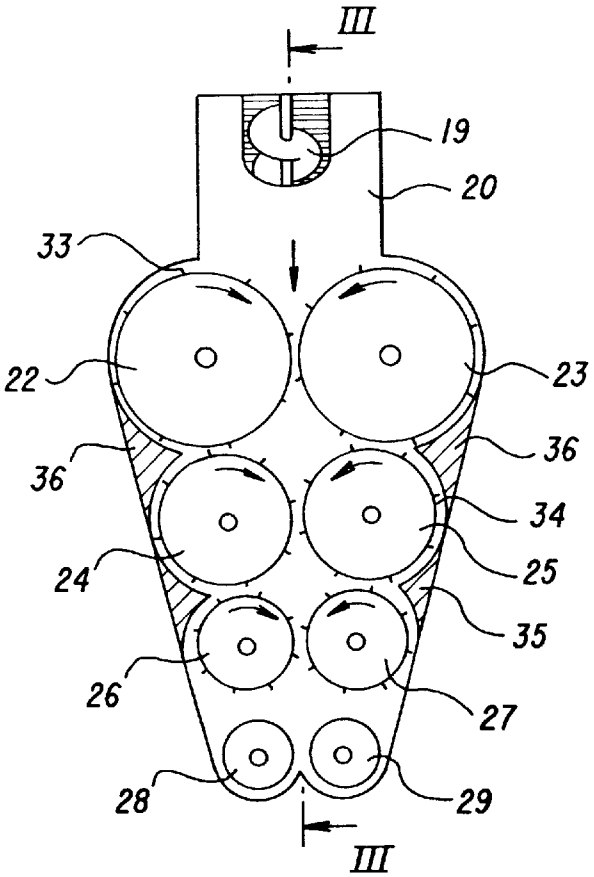
FIG. 3 shows a transverse section of the crusher viewed from the side.

The structure of the side output 5, according to one preferable embodiment, is presented in more detail in FIG. 2, which shows mixing tank 2 from above. The mixer 3 in the figure is mounted to rotate clockwise, which causes the material to be treated to rotate with the liquid in the same direction. At the side output 5 the wall of the tank is fitted to extend inwards, at least to some extent, that is, towards the centre of the tank on the leading side of the side output 5 (in the flow direction of the liquid). On the leaving edge, the wall is correspondingly extended outwards, which causes the leaving edge to be sheltered by the input edge as can be seen in the figure. This is intended to separate pebbles and other similar heavy solid impurities from the raw material for pulping, as the flow of liquid causes the pebbles to be flung against the wall of the tank and to sink along the wall to the bottom, wherefrom they are removed through the emptying funnel 4. Because the leading edge of the side output 5 is extended inwards, the pebbles "jump" over the opening of the side output 5, when they reach this point. On the other hand, lignocellulose raw material is sucked out through the side output due to the flow of liquid effected by the pump 7, because it is lighter than water.

From the input conveyor the chips are directed to the crusher 10; 20, where they are subjected to a crushing treatment. The essential part of the apparatus comprises 2–3 pairs of rolls 11, 12, 13 (FIG. 1) and 23–25, 33–35 (FIG. 3) with oblique grooves that are positioned in a spiral manner. The axles 30–32 of the rolls are fitted with bearings to the frame of the crusher, and the rolls can be turned in opposite directions. The rolls are positioned next to each other in such a manner that their longitudinal axes are, at least essentially, parallel and in a horizontal plane. To guide the chips onto the rollers, guide plates 21 have been fastened to the inner wall of the crusher.

The grooves 33–35 on the outer mantles of the rollers may comprise ridges winding around the outer surfaces or indentations formed on the mantles of the rollers. The ridges or corresponding indentations are formed in such a manner that inside the opening between the rolls the raw material is subjected to opposite forces that open the structure, which forces are at least essentially in the direction of the fiber. Sharp and cutting edges are to be avoided. Ridges or grooves may preferably be triangular in cross-section or shaped as the letter V upside down. For example, the side that moves material, on the edge of a ridge is preferably not in an angle of 90° with respect to the tangent of the nip, in order to avoid transverse cutting forces. The leaving angle of the ridge with respect to the tangent can be any angle, usually 5–90°. The apical angle of a V-shaped ridge or indentation is most suitably greater than 40°, preferably 45°–120°.

Between the rolls, an opening (gap) is formed, the slit dimensions of which can be adjusted by changing the distance of the rolls. The wood/fiber material to be crushed is fed into this gap. One of the rolls in a pair of rolls, for example, 22, 24, 26 is equipped with power, in other words, it is connected to a power source, and it rotates, with the aid of the fiber material, the other roll which then in turn rotates in the opposite direction. Seen from the direction of the input of the chips (that is, from above) the rolls rotate against each other. Due to the spiral construction and the opposite directions of rotation of the rolls, the material in the gap is ground to a crushed state. Because there is no contact between the rolls, there is no cleaving/cutting effect on the fiber material.

Prefereably, the spirals in the spiral structures of two adjacent rolls are of different handedness.

As described herein above, there may be 2 or 3 or even 4 pairs of rolls on top of each other. The fiber mass formed in the crushing treatment on the first pair of rolls 11; 22, 23 falls into the gap of the rolls 12; 24, 25 of the second stage. The second set of rolls comprises rolls which have smaller diameters than the first ones, wherefore their effective pressing surface is smaller, respectively, and the ratio of pressure per unit surface area is greater than in the first pressing stage. The peripheral speed is 2 to 3 times that of the first stage. The grooves of the second stage are less pronounced (that is, the depth of the groove or the height of the ridge is smaller) and the dimensions of the gap smaller than in the first stage. The peripheral speed of the rollers in the first stage is 2–10 m/s. If necessary, the apparatus can comprise a third or fourth pair of rolls (13; 26, 27) and when desired, the grinding action can be enhanced by placing the grooves more densely on the surfaces of the rolls of the second and the subsequent pairs of rolls.

The pulsating elevated/reduced pressure change of state described herein above takes place in the gap of the rolls by the action of spiral grooves (ridges).

The gaps of the rolls are selected in such a way that the chips fed in to the apparatus are subjected to an effective crushing action, which does not, however, cause the fibers to be cut. The dimensions of the gap are determined by the particle size and shape of the wood material to be treated. The gap must not be too small, because it is then easily blocked, and it should not be too large, because no crushing action would be achieved. Typically, the gap clearance in the first pressing stage is 0.5–2.5 times the average thickness of the chips. As an example, it can be stated that a gap clearance of 5–20 mm is suitable for the treatment of normal chips (with a thickness of 5–15 mm).

When using a crusher of the invention, a "fluid bag", formed of compressed material, builds up in front of, that is, above the gap of the crusher. As the gap pressure is released the fiber mass absorbs most of the fluid that was pressed out of it before. Therefore, the crushing step is performed within a liquid phase, which minimises the effect of cleaving the fibers. A fraction of the liquid that is released in the pressing step flows with the fiber material and another fraction is directed over the mantle and/or end of the pair of rolls into the next pressing stage below. The inner wall of the pressing apparatus can be fitted with guide plates 36 which direct the liquid flow from one roll into the gap between the next pair of rolls.

The wood mass (or wood/plant fiber mass; fiber mass), obtained in the pretreatment, is fed into the pulping stage, for example, with the aid of a spiral conveyor 14, 15; 28, 29. There may be several spiral conveyors on the bottom of the crusher.

Because the chips are washed and crushed at an elevated temperature, it is advantageous to cause both the tank 2 and the crusher 10 to be closed containers in order to reduce losses of liquid through evaporation. They can be closed, for example, with mantles.

In addition to the apparatus described herein above, crushing apparatus developed in the mining industry for crushing minerals, can also be used for performing the crushing step. The method can also be based on utilizing a screw press.

According to a preferable embodiment, at least a portion of the liquor flowing together with the chips (or corresponding raw material) is replaced by fresh cooking liquor after the crushing treatment. This can be accomplished by separating 10–80%, preferably about 30–60%, of the cooking liquor after the crusher in a standard output or, for example, in a screw press, whereafter fresh cooking liquor is fed into the spiral conveyor 14, 15; 28, 29. The fresh liquor fed into the spiral conveyor can be heated to the pulping temperature (70–110° C., preferably about 90–100° C.), which causes pulping to take place partly already in the spiral conveyor. In fact, the pulper may comprise the said spiral conveyor as is described herein below. In this case, it is fitted with a heating jacket to retain the temperature. The jacket can be heated, for example, with oil. The separated cooking liquor is washed and regenerated when necessary, and returned, for example, into the wash tank of chips, to be used in the washing and impregnation step. It is preferably connected to the recycling line of the wash tank before the heat exchanger 17.

The pretreated raw material can be pulped in a force feed (spiral or coaster) tube conveyor which causes the pulp mass to be in a state of being mixed continuously, or it can be pulped in a conventional batch process. According to a preferable embodiment pulping takes place in a continuously operated force fed tube pulper (which may be horizontal, vertical or reclined) with a cooking temperature of about 70–100° C., preferably about 90–100° C. and at normal atmospheric pressure, slight excess pressure or slightly reduced pressure. Temperature control is effected in an indirect manner either through a heat exchanger or the jacket of the pulper. When operating below normal atmospheric pressure, a pump is connected to the system, in order to cause the spiral conveyor to be under reduced pressure, which expressed as an absolute pressure is at least about 0.1 bar, preferably about 0.5 bar. By separating the crusher from the spiral pulper with a gate feeder or gate feed hopper it is possible to operate at normal atmospheric pressure, even if the spiral pulper is at reduced or elevated pressure.

The raw material treated according to the invention is suitable for the preparation of sulphate pulp, sulphite pulp, organosolv pulp, MILOX pulp and semichemical pulp. The cooking chemicals used are primarily sodium sulphide, sodium hydroxide, sodium (bi)carbonate, peroxoformic acid, peroxoacetic acid or alcohol. The invention can be especially preferably applied to pulps that are prepared in a suplhate process or by other alkaline methods, and with processes accomplished by using organic pulping chemicals.

In this context the term "sulphate process" is intended to mean a pulping process with cooking chemicals that essentially comprise sodium sulphide and sodium hydroxide. Extended pulping processes can be mentioned as examples of other alkaline pulping processes, based on continuing a conventional suplhate process, until the kappa value of the pulp has been reduced to below 20. These methods typically include a treatment with oxygen. These extended pulp cooking methods include, for example, extended batch cooking (with a pertinent addition of anthraquinone), EMCC (extended modified continuous cook), batch cook, Superbatch/$O_2$, MCC/$O_2$ and extended cook/$O_2$.

The invention can also be used to prepare sulphite pulp which is cooked either in acidic or neutral or even basic conditions, possibly in the presence of AQ-type or boron containing additives. The fiber material can be used to prepare pulp mass by sulphite/sulphide cook.

Cellulose pulp can be prepared also with organic cooking chemicals, by using aliphatic alcohols or carboxylic acids. Aliphatic alcohols are used, for example, in the so-called ORGANOSOLV process. Carboxylic acids and hydrogen peroxide can be used to form mixtures, the active component of which during pulp cooking is an organic peracid. One preferable alternative is so-called MILOX process. This process comprises three stages, in the first of which the lignocellulose containing raw material is first treated with formic acid and a small amount of hydrogen peroxide at a temperature of 60–80° C. In the second stage of the method the principal step for delignification is performed by elevating the temperature to 90–100° C., whereafter the brown pulp is treated in a third stage with a fresh aliquot of formic acid/hydrogen peroxide solution. During all the stages the formic acid concentration is more than 80%. Typical cooking times in the MILOX process are 1–3 hours, but due to the pretreatment of the invention the cooking times can be reduced to about 0.5–1 hours.

In addition to or instead of wood chips it is preferable to use annual plants as the raw material for especially the MILOX process, and instead of formic acid it is possible to use acetic acid, whereby the effective component of the cooking liquor is peracetic acid.

After precrushing the wood raw material, the cooking process used can be the same as applied to cooking fibers derived from annual plants.

After cooking the pulp most of the cooking liquor is separated therefrom with the aid of, for example, a screw press or a filterband press. The cooking liquor is regenerated by using known processes, for example, in a soda recovery boiler or by azeotropic distillation. The pulp mass is washed and subjected to bleaching if desirable, in order to continue delignification in successive steps and in a way that depends on the pulp cooking process.

The pulp produced from raw material treated according to the invention can be bleached according to a method that is known as such, without chlorine and/or with chlorine containing chemicals. Nowadays, bleaching of cellulose pulp is to a large extent based on bleaching chemicals that are free from chlorine gas, such as oxygen, hydrogen peroxide and ozone, as well as chlorine dioxide. Prior to these bleaching steps, heavy metals are removed from the pulp to be bleached by chelating as the heavy metals catalyse rections that are adverse from the point of view of pulp quality. In cellulose pulps the heavy metals are mainly bound to carboxylic acid groups.

What is claimed is:

1. A process for producing a cellulose pulp from wood chips, comprising:

(1) prewashing the wood chips with a cooking liquor;

(2) crushing the prewashed wood chips in a liquid phase to open up the fiber structure of the wood chips in the direction of the length of the fibers;

(3) delignifyina the wood chips obtained in step (2) with the cooking liquor to obtain cellulose pulp; and (4) optionally, bleaching the cellulose pulp.

2. A process according to claim 1, comprising subjecting the prewashed wood chips to pulsating pressure strikes.

3. A process according to claim 1, wherein the wood chips are prewashed at about 35–95° C.

4. A process according to claim 3, comprising prewashing the starting material at about 40–60° C.

5. A process according to claim 1, wherein the liquid phase used during the crushing treatment is cooking liquor.

6. A process according to claim 5, comprising recycling the cooking liquor to the pretreatment through a purification step and optionally a heat exchanger.

7. A process according to claim 1, wherein the crushing treatment is performed in a continuously operating crusher.

8. A process according to claim 1, wherein the liquid content during the crushing treatment is 40–60%.

9. A process according to claim 1, wherein the crushing treatment yields a fiber suspension with a liquid content (amount of liquid of the dry weight of the fiber) of about 40–60%.

10. A process according to claim 9, wherein the crushing treatment yields a fiber suspension with a liquid content of about 50%.

11. A process according to claim 1, comprising cooking the wood chips obtained from the crushing treatment in a cooking liquor at a temperature of about 70–100° C.

12. A process according to claim 11, wherein the cooking is performed at reduced pressure to remove air from the crushed wood chips.

13. A process according to claim 1, wherein the cooking liquor comprises principally sodium sulphide, sodium hydroxide, sodium (bi)carbonate, peroxoformic acid or alcohol.

14. A process according to claim 1, wherein the cellulose pulp is bleached without the use of chlorine containing chemicals.

15. A process according to claim 1, wherein the wood chips are selected from the group consisting of pine, spruce, birch, aspen, alder, eucalyptus, maple and tropical hardwood.

* * * * *